US005202013A

United States Patent [19]

Chamberlain et al.

[11] Patent Number: 5,202,013

[45] Date of Patent: Apr. 13, 1993

[54] PROCESS FOR COLORING METAL SURFACES

[75] Inventors: Bryn Chamberlain; Harry Sang; Dan Fern, all of Ontario; Prasad Apté, Alberta; Lorne D. Kenny, Ontario, all of Canada

[73] Assignee: Alcan International Limited, Montreal, Quebec, Canada

[21] Appl. No.: 776,611

[22] Filed: Oct. 15, 1991

[51] Int. Cl.[5] ..... C25D 5/00

[52] U.S. Cl. ..... 205/229; 205/120; 205/220; 205/222

[58] Field of Search ..... 205/229, 222, 220

[56] References Cited

U.S. PATENT DOCUMENTS

| | | | |
|---|---|---|---|
| 3,265,239 | 8/1966 | Kohan et al. | 220/64 |
| 3,432,407 | 3/1969 | Ricci | 205/222 |
| 3,551,303 | 12/1970 | Suzuki et al. | 205/229 |
| 4,562,090 | 12/1985 | Dickson et al. | 205/222 |
| 4,837,061 | 6/1989 | Smits et al. | 428/40 |
| 4,994,314 | 2/1991 | Rosenfeld et al. | 428/36.92 |

OTHER PUBLICATIONS

Kenny and Sang—"Metal Transfer and Galling in Metallic Systems"—Orlando, Fla. Oct. 8-9, 1986.

*Primary Examiner*—John Niebling
*Assistant Examiner*—Kishor Mayekar
*Attorney, Agent, or Firm*—Cooper & Dunham

[57] ABSTRACT

A process for coloring a metal surface and colored metal products thus produced. The process involves forming a layer of a metal oxide on a surface of the metal to be colored and then bringing about permanent plastic deformation of the surface. If the oxide layer is of a suitable thickness (e.g. 500Å-1 μm) and the deformation is sufficiently high (preferably producing a reduction in thickness of the metal article by 30% or more), the resulting metal article exhibits an attractive color (usually a dichroic pastel color). The article can then be fabricated into finished articles, e.g. beverage cans, in the usual way.

8 Claims, 2 Drawing Sheets

PROCESS FOR COLORING METAL SURFACES

BACKGROUND OF THE INVENTION

I. Field of the Invention

This invention relates to a process for coloring surfaces of articles made of metals, especially those made of aluminum and anodizable aluminum alloys. More particularly, the invention relates to a process of this kind which avoids the need for the use of organic or inorganic pigments to achieve the desired coloring effect.

II. Discussion of the Prior Art

It is commonplace in the manufacturing industry to provide articles made of aluminum or aluminum alloy with colored surfaces in order to enhance the decorative appeal of such articles. For example, many beverage cans are made from aluminum alloys nowadays and the outer surfaces of such cans are commonly provided directly with a coating of colored paint or lacquer rather than a paper label or the like. Numerous other articles made out of aluminum are also provided with similar coatings for decorative or marketing purposes.

In addition to coloring aluminum surfaces with paint or lacquer, it is also known to provide such surfaces with a porous anodic film and to introduce an organic or inorganic coloring agent into the pores of the film. Organic pigments introduced into the pores in this way normally create a colored surface by the selective absorption of particular wavelengths of light. Inorganic pigments, such as small metal deposits, may produce a colored effect in the same way or, more usually, by effects including both light absorption and light scattering.

It is also possible to use metal deposits or discontinuous metal layers to create visible colors by light interference effects, for example as disclosed in our copending U.S. patent application Ser. No. 497,222 filed on Mar. 22, 1990. In such cases, light reflected from the metal deposits interferes with light reflected from the underlying metal surface and/or the outer anodic film surface to create interference effects. Non-dichroic or dichroic colors can be produced in this way and colors of good intensity from a broad spectrum can usually be generated.

The problems with the conventional coloring processes of the kinds mentioned above are that the coloring procedures can be difficult and expensive to operate and they necessarily introduce a foreign material, such as a paint or pigment, onto or into the surface of the aluminum article. Such materials must be removed when the aluminum article is recycled, thus complicating the recovery procedure. However, when attempts have been made to color aluminum surfaces using thin anodic films alone, the resulting coloring effects (even when obtained at all) are of very low intensity to the extent that they are not useful for commercial articles.

OBJECTS OF THE DISCLOSURE

It is an object of the present invention to provide a process for coloring metal articles without the use of organic or inorganic pigments.

Another object of the invention is to provide a process for coloring metal articles which can create pastel colors selected from a broad spectrum.

A further object of the invention, at least in its preferred forms, is to provide a colored article made of aluminum or anodizable aluminum alloy which contains no pigments, deposits, lacquers or paints.

Yet a further object of the invention is to provide a colored metal article which can be recycled with maximum ease and minimum expense.

SUMMARY OF THE INVENTION

According to the invention there is provided a process for coloring a metal surface, which process comprises: forming a layer of metal oxide on said surface; and causing permanent plastic deformation of said surface; wherein said layer is of such a thickness and said deformation is of such a degree that said layer generates a visible color when illuminated with white light.

The invention also relates to a colored metal article produced by the above process.

An advantage of the present invention is that the oxide layer on the surface of the colored article produced in this way contains no foreign pigmenting materials whatsoever. There are therefore no foreign substances requiring additional expensive steps during manufacturing and disposal of the article. Furthermore, metal oxides are inert and generally non-toxic, so the color generated by the process of the invention is resistant to fading and to contamination of foodstuffs or the like with which the article may be used.

DETAILED DESCRIPTION OF THE INVENTION

Figure 1:
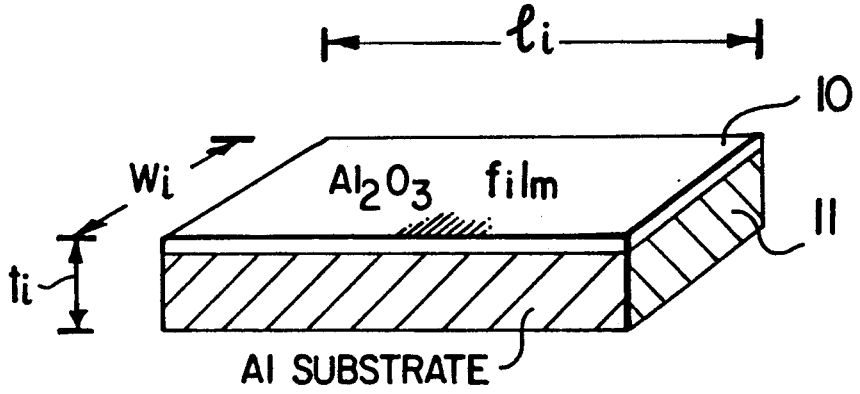
FIGS. 1 and 2 are perspective views of a plate-like article carrying an oxide layer respectively before and after permanent plastic deformation of the coated surface in accordance with a preferred form of the process of the present invention.

Quite unexpectedly, it has been found that uncolored, or only faintly colored, oxide-covered surfaces of metals can be made to exhibit attractive colors (usually dichroic pastel colors) when the metal surfaces are subjected to permanent plastic deformation such as, for example, by conventional drawing, stretching, rolling, ironing, and similar techniques. Such techniques are conventional and well-known to persons skilled in the art, although details of metal ironing processness can be found in an article entitled "Effects of Particles on Scoring and Friction in Ironing" by Kenny and Sang, published in "Metal Transfer and Galling in Metallic Systems", 1986, The Metallurgical Society Inc., the disclosure of which is incorporated herein by reference.

The required oxide coatings can be formed on the metal surfaces by any suitable technique, e.g. by vacuum sputtering or sol-gel techniques, and in such cases virtually any metal can be colored in this way, provided the metal has suitable deformability. However, a preferred way of forming the oxide coatings on the metal surfaces is by anodization of an anodizable metal to form an anodic oxide film of the desired thickness on the surface of the metal. Suitable anodic films can be formed, for example, by porous anodization of aluminum or anodizable aluminum alloys, although similar results can be obtained by non-porous (barrier layer) anodization of aluminum and other metals, provided films of the required thickness can then be produced (barrier layer anodization terminates after the barrier film has reached a certain thickness, the value of which depends on the anodization voltage, whereas the thickness of porous films is not usually limited in this way).

Porous anodization of aluminum or aluminum alloys is generally carried out in an electrolyte containing an acid, such as sulphuric acid, phosphoric acid, chromic or oxalic acid, which slowly dissolves or attacks the oxide of the anodic film and forms open pores which extend inwardly from the outer surface of the anodic film. Direct or alternating voltages preferably in the range of 5-25 V may be employed at suitable current densities and for suitable times (e.g. 1.6 Amps/(dm)$^2$ [15 Amps/sq.ft.] for periods of about 30 seconds at ambient temperature). After formation of the porous film, the film may be sealed, if desired, by placing the film in a bath of boiling water to hydrate and expand surface oxide layers, thus closing the open ends of the pores.

No matter how the oxide film is formed, however, plastic deformation of the underlying metal surface somehow modifies the oxide layer so that it generates a visible color. It is not precisely known how this coloring effect takes place but, without wishing to be limited to any particular theory, it is believed that the deformation of the metal surface causes fracturing and/or deformation of the oxide layer in way which creates an optical defraction grating or closely spaced reflective surfaces which produce color by optical interference effects. In any event, some kind of physical change takes place within the oxide layer which causes color to be generated when the treated oxide layer is illuminated with white light.

While all of the factors which affect the hue and intensity of the generated colors have not been precisely identified, the following factors appear to have an effect:

(1) the initial film thickness;
(2) the nature of the metal;
(3) the nature of the deformation step (rolling, ironing, etc. and degree of deformation); and
(4) the chemistry of the oxide layer which, in those cases where the oxide layer is a porous anodic film, may result from the composition of the electrolyte used for anodization and the composition of the aluminum or alloy subjected to the anodization.

The starting thickness of the oxide film is important for achieving the desired coloration because, if the film is either too thick or too thin, suitable colors may not be generated. In general, the starting thickness of the oxide coating should desirably be in the range of 500Å-1 μm. Ideally, although possibly depending on the nature of the oxide and metal, the oxide coating should have a thickness of about 0.5 μm.

The degree of plastic deformation is also important and different degrees of deformation produce different colors. However, as well as creating different colors by deforming the metal surface to different extents, different colors can also be created by starting with different anodic film thicknesses and applying the same degree of deformation. By suitably changing the above factors in accordance with simple trial and experimentation, different hues and intensities can be produced. The deformation is such that the thickness of the metal is reduced by 5% or more.

The deformation step is most effective when it causes an overall reduction in total thickness of the metal substrate of about 30% or more, although a colored effect can often be obtained when only surface deformation is carried out. Because overall thickness reduction of this degree is usually necessary for good color generation, the process is not generally suitable for coloring shaped products, but is ideal for coloring flat foils, sheets or plates of substantially any thickness, e.g. foils of 15-100 μm, sheets of 100-2500 μm and plates of 2500 μm - 5 cm, which can be subjected to deformation prior to use.

It is a particular advantage of the present invention, at least in certain aspects, that the deformation step required for color generation can be combined with the fabrication step carried out during the normal working of the foil, sheet or plate material.

If desired, different areas of an oxide-coated product may be subjected to different deformation techniques or to different degrees of deformation in order to form areas having different hues or intensities of color.

Furthermore, if desired, the metal on which the oxide layer is formed may be a thin layer supported on a different metal. This is useful, for example, when the film is to be formed by porous anodization of aluminum on a non-porousanodizable metal substrate. In such cases, the substrate metal is first coated with a thin aluminum layer which is then subjected to porous anodization and the entire structure, or just the surface layer, may be subjected to deformation.

Once the colored flat metal product has been formed, it can be fabricated in the normal way into a range of products, e.g. beverage cans, architectural materials, decorative products and the like.

Figure 2:
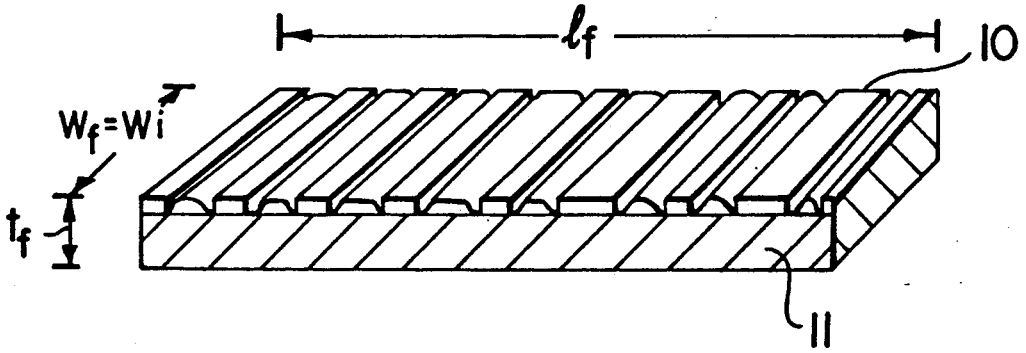

FIGS. 1 and 2 of the accompanying drawings show the effects which may be responsible for the generation of color, although it is stated again that this explanation is speculative at this time.

FIG. 1 shows an anodic film 10 formed on an aluminum substrate 11 (preferably by porous anodization). Before deformation, the structure has an initial length of $l_i$, an initial width of $w_i$ and an initial thickness of $t_i(=t_{(oxide)i}+t_{(Al)i})$.

FIG. 2 shows the same structure after it has been ironed. The structure has a length $l_f$, a width $w_f$ and a thickness $t_f(=t_{(oxide)f}+t_{(Al)f})$, wherein:

$$l_f > l_i$$
$$w_f \approx w_i$$
$$t_f < t_i$$
$$t_{(oxide)f} \approx t_{oxide)i}$$

Thus the width of the structure and the thickness of the oxide layer does not change much, but the oxide layer becomes fractured or striated at the microscopic level, and this appears to result in the formation of a defraction grating.

The invention is illustrated in further detail by the following non-limiting Examples.

EXAMPLE 1

Aluminum sheets having a thickness of 300 μm were first subjected to a caustic etching step for a period of 30 seconds and then the etched surfaces were rinsed in water having a neutral pH. The surfaces were then anodized in 165 g/l $H_2SO_4$ at 21° C. at 15V DC and 1.6 Amps/(dm)$^2$. The resulting anodic films were double rinsed, first with a solution at low pH and then by a solution at neutral pH.

The resulting anodized sheets were then subjected to pressing steps as follows with the indicated results:

Ironing Transverse Samples 0.5 μm coating from $H_2SO_4$

-continued

| | | |
|---|---|---|
| | 37.2% Reduction | Green |
| | 23.9% Reduction | Pink/Purple |
| | 9.1% Reduction | Pink |
| | Longitudinal Samples | |
| | 36.8% Reduction | Blue |
| | 36.1% Reduction | Green |
| | 45° Samples | |
| | 28.3% Reduction | Blue |
| Rolling | Transverse Samples | |
| | 40.0% Reduction | Green |
| | 29.0% Reduction | Yellow/Red |
| | 23.0% Reduction | Pink/Red/Purple |
| | Longitudinal Sample | |
| | 36.8% Reduction | Blue |

Can Line Trials

Cans were created in a two-step process in which a shallow cup was drawn from a flat circular piece of canstock sheet (draw ratio=2.5), and two sides of the cup were lengthened by forcing the product through 3 successively smaller circular ironing dies to produce an overall reduction of 60% ). Cans made in this way from the following feedstocks, each of which was provided with a 0.5 μm porous oxide film, had the following colors:

| | |
|---|---|
| Logan 3004 | |
| Desmutted* | Blue |
| No Desmut | Green |
| No Desmut | Blue/Green |
| Continuous Cast | |
| Desmutted | Pink/Orange |
| No Desmut | Gold/Red |

*Desmutting removes alloying elements (e.g. Fe, Si and Cu) from the Al surface.

EXAMPLE 2

The above procedure was repeated using different acids or acid contents in the electrolyte and different deformation conditions. The samples were then cold rolled in the original rolling direction. These conditions and the resulting colors are shown in the table below.

TABLE

| ANODIC FILM THICKNESS | ACID PRESENT IN THE ELECTROLYTE | DEFORMATION CONDITIONS | COLOR OBTAINED |
|---|---|---|---|
| 0.4 μm | $H_2SO_4$ | rolling with lubrication | blue |
| 0.5 μm | $H_2SO_4$ | rolling with lubrication | green |
| 0.5 μm | $H_2SO_4$ | rolling without lubrication | ½ pink/ ½ green |
| 0.42 μm | citric acid | rolling with lubrication | no color |

EXAMPLE 3

Aluminum alloys 5182 and 3004 were subjected to anodization in a sulphuric acid solution to produce a porous anodic film having a thickness of approximately 0.5 μm. The anodized samples were subjected to strip ironing to cause a reduction of thickness of 9.1%, 19.1% and 37.2% in each case. Each of the films exhibited pink, orange and green colors, respectively.

EXAMPLE 4

AA 3004 can body stock (half inch grade) was anodized in a $H_2SO_4$ bath so as to attain a 0.5 μm oxide coating. The anodized samples were then cold rolled to the following thickness reductions with the indicated results:

| % Reduction | Color | Rolling Direction relating to previous rolling |
|---|---|---|
| 18.0% | Yellow/Green | Parallel to Rolling lines |
| 34.2% | Yellow | Parallel to Rolling lines |
| 35.0% | Blue | Parallel to Rolling lines |
| 36.0% | Blue | Parallel to Rolling lines |
| 50.4% | Blue/Green | Parallel to Rolling lines |
| 29.0% | Orange/Pink | Perpendicular to Rolling lines |
| 40.0% | Green | Perpendicular to Rolling lines |

EXAMPLE 5

X319 can stock 0.0118 sheet from Oswego was porous anodized so as to attain anodic film thicknesses of 0.1, 0.25 and 0.5 μm. The anodizing process comprised:

1) 30 seconds in a caustic etch tank,
2) Rinse

| | | |
|---|---|---|
| 3) | 17 seconds | 0.1 micron |
| | 33 seconds | 0.25 microns $H_2SO_4$ Anodic bath, 9.69 Amps, ramping voltage sharply |
| | 67 seconds | 0.5 microns |

4) Rinse in neutral pH.
5) Rinse in neutral pH.

The samples were then put through a can line. The following colors were observed:

0.1 - micron Yellow
0.25 - micron Blue
0.5 - micron Green.

EXAMPLE 6

Figure 3:
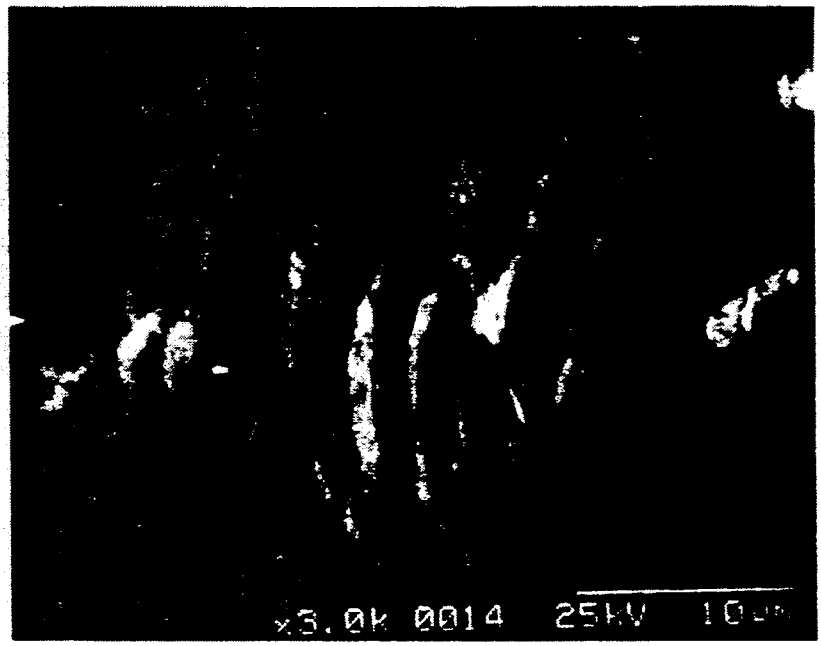
FIGS. 3 and 4 are photomicrographs of samples according to the present invention produced according to the Examples provided in the following description.
Figure 4:
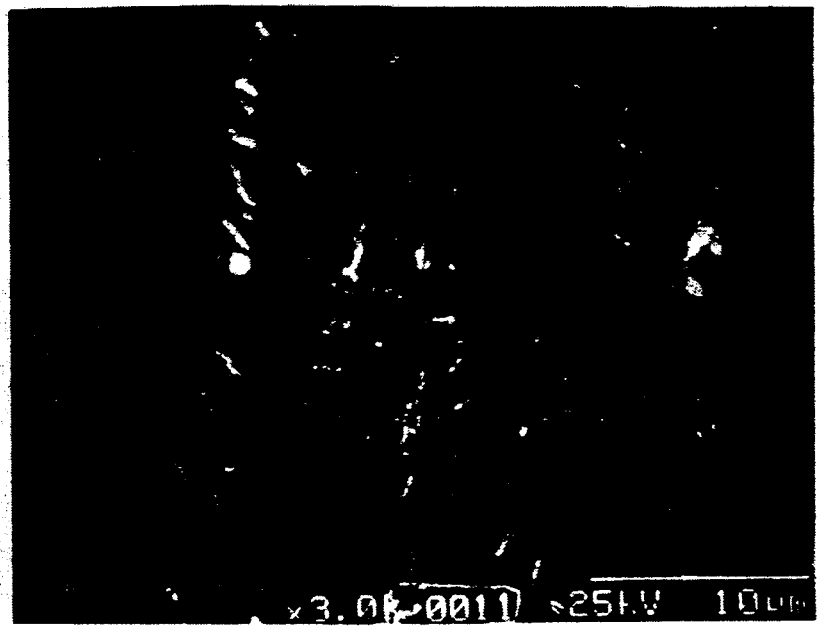

An aluminum alloy strip was porous anodized in $H_2SO_4$ to form a porous anodic film having a thickness of 0.5 μm. One sample of the oxide coated metal was subjected to ironing to 30% reduction of thickness at 45° to the rolling direction and another sample was rolled parallel to the rolling direction. The condition of the oxide films is shown at 300× magnification in FIGS. 3 and 4, respectively. The fractured condition can clearly be seen. These samples exhibited the following colors:

| %age Thickness Reduction | Color Produced |
|---|---|
| 10 | Orange/yellow |
| 19 | Red/orange |
| 30 | Green |

We claim:

1. A process for coloring a surface of a metal layer having a thickness, which process comprises:

forming a layer of metal oxide on said surface; and causing permanent plastic deformation of said surface such that said thickness is reduced of said metal layer by 5% or more;

wherein said layer of metal oxide is of such a thickness and said deformation is of such a degree that said oxide layer generates a visible color when illuminated with white light.

2. A process according to claim 1 wherein said metal is an anodizable metal and said oxide layer is an anodic film formed on said surface by anodization.

3. A process according to claim 2 wherein said metal is selected from the group consisting of aluminum and anodizable aluminum alloys.

4. A process according to claim 3 wherein said anodic film is a porous film produced by porous anodization.

5. A process according to claim 1 wherein said oxide layer has a thickness in the range of 500Å–1 μm.

6. A process according to claim 1 wherein said oxide layer has a thickness of about 0.5 μm.

7. A process according to claim 1 wherein said permanent plastic deformation is produced by a procedure selected from the group consisting of drawing, stretching, rolling and ironing.

8. A process according to claim 1 wherein said surface is a surface of a metal material selected from the group consisting of foil, sheet and plate.

* * * * *